US005475361A

United States Patent [19]

Curran et al.

[11] Patent Number: 5,475,361

[45] Date of Patent: Dec. 12, 1995

[54] STROBE WARNING LIGHT

[75] Inventors: John W. Curran, Lebanon; Luy Nguyen, Ocean; Joseph Kosich, South Toms River, all of N.J.

[73] Assignee: Wheelock, Inc., Long Branch, N.J.

[21] Appl. No.: 64,279

[22] Filed: May 20, 1993

[51] Int. Cl.[6] ..... G08B 5/00

[52] U.S. Cl. ..... 340/331; 362/297; 362/217

[58] Field of Search ..... 340/331; 362/297, 362/299, 300, 217, 223

[56] References Cited

U.S. PATENT DOCUMENTS

| | | | |
|---|---|---|---|
| 4,261,030 | 4/1981 | Hernandez | 362/217 |
| 4,507,717 | 3/1985 | Wijbenga | 362/223 |
| 4,531,180 | 7/1985 | Hernandez | 362/297 |
| 4,575,788 | 3/1986 | Lewin | 362/297 |
| 4,626,744 | 12/1986 | Saburo | 362/297 |
| 5,055,976 | 10/1991 | Arai | 362/223 |

*Primary Examiner*—Brent Swarthout
*Assistant Examiner*—Nina Tong
*Attorney, Agent, or Firm*—Brumbaugh, Graves, Donohue & Raymond

[57] ABSTRACT

The reflector of a strobe warning light for mounting on a wall has reflective surfaces for enhancing the amount of light projected into a sector defined by a horizontal reference plane and a vertical reference plane that intersect at the lamp axis, the lamp being oriented horizontally. Two wing-like reflective surfaces reflect light into a zone of the sector from 10 degrees to 40 degrees from the horizontal reference plane. Two other wing-like reflectors that adjoin the first two reflect light generally parallel to the lamp axis in opposite directions to increase the light intensity as the light is viewed from the sides. The wing-like reflective surfaces are located in diagonally opposite quadrants with respect to the horizontal reference plane and a plane at the lamp centerline perpendicular to the lamp axis, thereby leaving openings in the remaining two quadrants. A concave reflective surface behind the vertical reference plane reflects light away from the wall. A lens over the lamp has a concave reflective surface that reflects light generally downwardly to enhance the light output in the 70 to 90 degree range from the horizontal reference plane.

16 Claims, 3 Drawing Sheets

STROBE WARNING LIGHT

BACKGROUND OF THE INVENTION

Regulations relating to fire safety have become more stringent in recent years. For example, one aspect of relatively new Federal Regulations relating to handicapped persons is the requirement for visual fire warning systems for the hearing-impaired in various types of public spaces. Visual alarms using strobe lights are well-known and in widespread use, primarily in industrial and vehicular settings. They will in the future be more frequently installed in public spaces in institutional and commercial buildings, not only when required but as a preferred safety practice.

Strobe lamps are elongated tubes. As such, the light they produce is not uniform in all directions. The light that radiates perpendicularly from the lamp relative to its axis is of uniform intensity. However, the light output in the plane of the lamp axis diminishes substantially as a function of the cosine of the angle between the radial line in the plane and all other lines. Near and at + and –90°, i.e., when the lamp is observed from either end, the light output is but a small fraction of its output in the radial direction.

Underwriters Laboratories (UL®) has recently adopted standards that require certain levels of light output from strobe alarm lights for fire safety warning systems in (1) a plane perpendicular to the lamp axis and (2) the plane that is perpendicular to that plane and includes the lamp axis. (Throughout this specification, the term "light" refers to a system that consists of a strobe lamp bulb, a support that may include a reflector, and a lens, and the term "lamp" refers to the light-emitting strobe light bulb element.)

One way of meeting the requirement is to equip the strobe light with two lamps, one perpendicular to the other. That way is costly and also requires more electric current, which for a given battery storage capacity reduces the operating time of the device or for a given operating time requires more battery storage capacity, another additional cost. Another possible way of meeting the UL® requirement for plane 2 is with a specially designed lens, but that means diverting light and thus requires reducing the light output in directions other than plane 2.

U.S. patent application Ser. No. 08/031,949 (Jongewaard, filed Mar. 16, 1993), which is owned by the assignee of the present invention, describes and shows a reflector for a strobe warning light that provides enhanced light output at high angles from the radial in the plane of the lamp axis and a high light output for a given lamp output at all angles in planes perpendicular to the lamp axis, thereby permitting the lamp current draw to be kept low for any given light output. The enhanced light output at high angles with respect to the radial line in the plane of the lamp axis is obtained by concave reflective surfaces on "wings" of the reflector adjacent each end of the lamp. High efficiency of light utilization in the plane perpendicular to the lamp axis is obtained by a semicylindrical concave reflective surface of the reflector having as its axis the axis of the lamp. The axis of the lamp is located at or above the edges of the semicylindrical reflective surface and the wings. The respective wings are located on opposite sides of a reference plane perpendicular to the base plane of the reflector that includes the lamp axis, and the reflective surfaces of each wing is configured and oriented such that it reflects light generally parallel to the lamp axis along the same side of the reference plane on which it is located. Inasmuch as the present invention, preferably, includes wings of the type described and shown in the above-mentioned Jongewaard application, it is hereby incorporated into the present specification by reference.

Underwriters Laboratories has established requirements for the light output of strobe warning lights that are mounted on a wall that are different from those established for strobe warning lights that are mounted on a ceiling. The requirements for wall strobe warning lights permits lesser light output at high angles approaching the vertical and do not require any light output above a horizontal plane, i.e., toward the ceiling. These requirements present opportunities for modifying the light output of a plain (bare) strobe lamp by a reflector that makes maximum use of the available light from the lamp.

SUMMARY OF THE INVENTION

There is provided, in accordance with the present invention, a strobe warning light for use on a wall that for any given light output has a low current consumption by virtue of making highly efficient use of the lamp light output. In essence, the UL® requirements for wall-mounted strobe warning lights call for the light from the lamp to be directed into a sector defined by a horizontal reference plane and a vertical reference plane intersecting along a line that is coincident with the lamp axis. The requirements also include minimum light outputs in a horizontal plane that includes the lamp axis and minimum light outputs within the sector in a plane perpendicular to the lamp axis at the centerline of the lamp.

Thus, the present invention is a strobe warning light that projects light predominantly into a sector defined by mutually perpendicular first and second reference planes intersecting at a line L. The light comprises an elongated strobe lamp having a longitudinal axis, a lamp support supporting the lamp with its axis coincident with the line L and centered on a third reference plane that is perpendicular to the first and second reference planes, and a reflector on the support. The reflector includes a first reflective surface that is positioned in a first quadrant defined by the first and third reference planes and is on the same side of the second reference plane as the sector and that is configured and oriented to reflect light from the lamp into the sector predominantly in a range of angles of from about 10 degrees to about 40 degrees with respect to the first reference plane.

The reflector, preferably, includes a second reflective surface that is positioned in a second quadrant defined by the first and third reference planes that is diagonally opposite from the quadrant in which the first reflective surface is located and is on the same side of the second reference plane as the sector. The second reflective surface is configured and oriented to reflect light from the lamp into the sector predominantly in a range of angles of from about 10 degrees to about 40 degrees with respect to the first reference plane. The first and second reflective surfaces together enhance the light output in a direction away from the wall on which the light is mounted and somewhat downwardly so that the light from the lamp is highly visible at large distances. The first and second reflective surfaces may be planar and, in order to reflect the light from the lamp in the desired directions, are oriented obliquely to all three reference planes at different angles with respect to each of the reference planes so as to reflect light from the lamp into substantially the same region of the sector. Locating the first and second reflectors in diagonally opposite quadrants leaves openings in the remaining two quadrants through which the light can pass generally parallel to the axis of the lamp, thereby enabling the reflector wings of the above-mentioned Jongewaard application to be provided.

In particular, the reflector, preferably, includes a third reflective surface that is positioned in the first quadrant on the opposite side of the second reference plane from the sector and a fourth reflective surface positioned in the second quadrant on the opposite side of the second reference plane from the sector, the third and fourth reflective surfaces facing generally toward each other and being configured and oriented to receive light from the lamp and reflect it opposite directions along paths generally parallel to the lamp axis and on opposite sides of the first reference plane so that each one of the third and fourth reflective surfaces directs reflected light predominantly past the other of the third and fourth reflective surfaces. The third and fourth surfaces can be substantially identical and located symmetrically with respect to the center of the lamp and are doubly concavely curved such that they reflect light within predetermined angles with respect to the lamp axis in planes parallel to the first reference plane and within predetermined angles with respect to the lamp axis in planes parallel to the second reference plane.

In accordance with the invention, the reflector further includes a fifth reflective surface that is located on the opposite side of the second reference plane from the sector and is configured and oriented to reflect light from the lamp in divergent directions generally radially with respect to the lamp axis in the direction of the sector with respect to the second reference plane. The fifth reflective surface is a segment of a cylindrical reflective surface, such as a parabolic surface, that is concave with respect to the axis of the lamp and has its axis coincident with the axis of the lamp. Preferably, the third and fourth reflective surfaces adjoin the fifth reflective surface, and portions of the fifth reflective surface opposite from the junctures of the fifth reflective surface with the third and fourth reflective surfaces extend beyond the extremeties of the lamp such as to reflect light generally laterally with respect to the third reference plane.

The strobe warning light, preferably, has a transparent lens covering the lamp and the reflector. A reflective surface that is associated with the lens, such as a reflective coating or a separate member attached to the lens, and that is located on the same side of the second reference plane as the sector and on the opposite side of the first reference plane from the sector is configured and oriented to reflect light from the lamp into the sector predominantly in a range of angles of from about 70 degrees to about 90 degrees with respect to the first reference plane. The reflective surface associated with the lens may be a segment of a cylindrical reflective surface that is concave with respect to the axis of the lamp and has its axis substantially parallel to the axis of the lamp. The reflective surface associated with the lens is substantially coextensive with the lamp in the axial direction.

The strobe warning light makes efficient use of the available light from the lens by (1) enhancing the light output in the range of angles in the plane perpendicular to the lamp axis from 10 degrees to 40 degrees; (2) providing for increased light output generally parallel to the axis of the lamp; (3) reflecting most of the light in a direction away from the wall (the second reference plane); and (4) reflecting light that would otherwise be directed toward the ceiling downward by means of the reflective surface associated with the lens.

For a better understanding of the invention, reference may be made to the following description of an exemplary embodiment, taken in conjunction with the figures of the accompanying drawings.

DESCRIPTION OF THE EMBODIMENT

Figure 1:
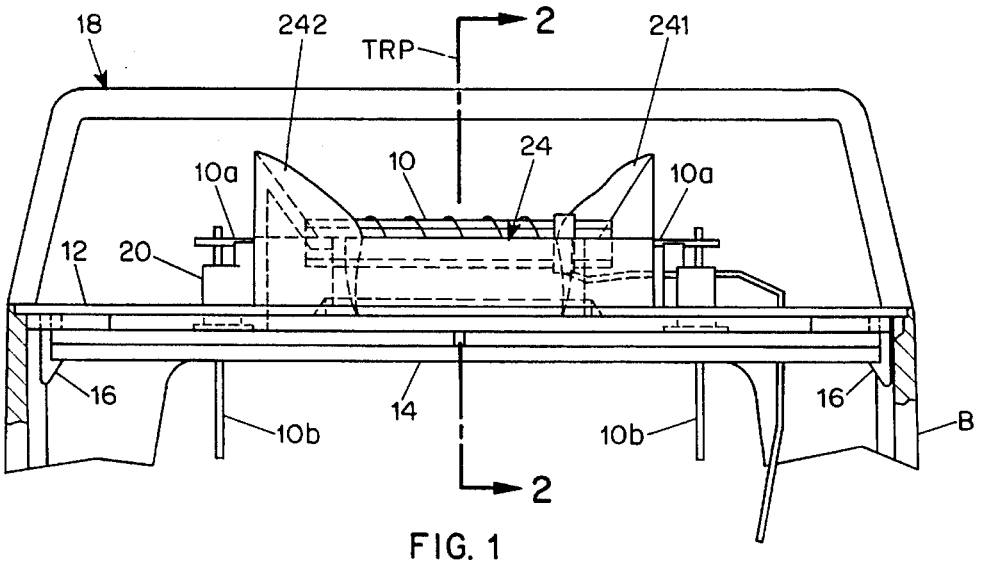
FIG. 1 is a bottom (with respect to the installed condition of the light) cross-sectional view of the embodiment.
Figure 2:
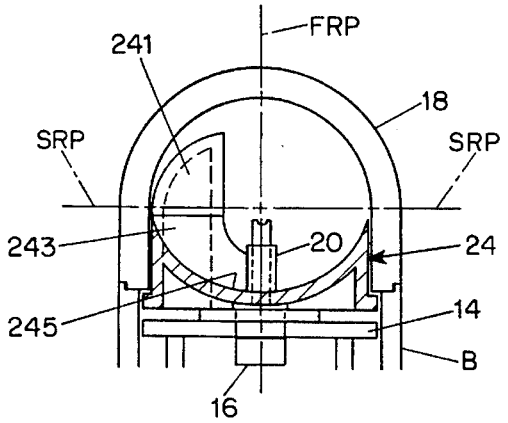
FIG. 2 is an end cross-sectional view of the embodiment, taken along the line 2—2 of FIG. 1.

The strobe light of FIG. 1, like conventional strobe lights, has a strobe lamp 10 (the light-emitting bulb element), which is mounted on and affixed to a support 12 in a predetermined position. The support 12, in turn, is attached to a printed circuit board 14, such as by lugs 16 that snap into slots in the board. The support and board are mounted on a base B, the details of which are a matter of routine design. A lens 18 fits over the lamp and the support.

The support 12 is injection-molded from a suitable polymeric material and is in the form of a thin elongated plate over most of its extent. A pair of lamp-supporting posts 20 extend out from one face and receive the lamp electrodes 10*a* in grooves in their upper surfaces. Holes 20*a* in the posts receive the electrode leads 10*b* of the lamp, which protrude through the plate and plug into sockets on the circuit board. The lead 10*c* from the trigger coil of the lamp passes through a hole 23 in the support.

Figure 6:
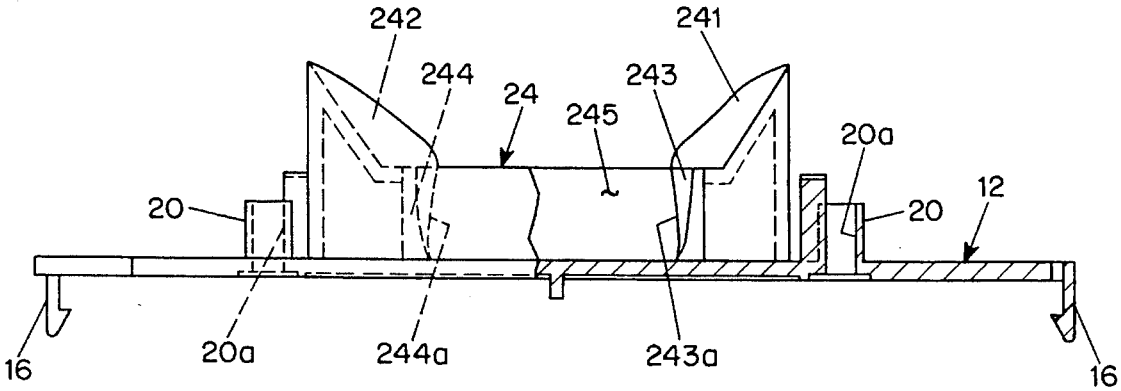
FIG. 6 is a half bottom cross-sectional view of the reflector, the section being taken generally along a plane represented by the line 6—6 of FIG. 3.
Figure 7:
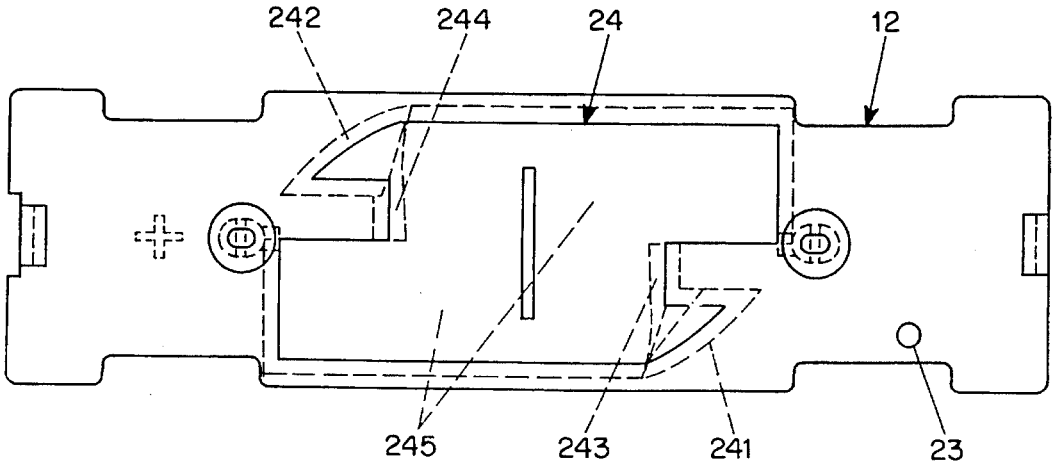
FIG. 7 is a rear elevational view of the reflector.

The reflector 24, which embodies the present invention, is molded into and is thus integral with the support 12. It may, however, be a separate component and be suitably attached to the support. To aid in an understanding of the following description of the reflector, it is first necessary to define the sector into which the light from the strobe is predominantly to be emitted and the reference planes that define the sector and the locations of the surfaces of the reflector that accomplish the objectives of the invention. In FIGS. 1 and 6, a plane parallel to the paper and including the lamp axis is the first reference plane, hereinafter "FRP"; the section line 6—6 lies in the FRP. In most installations of the strobe warning light, the FRP is parallel to the ceiling, and the light will be installed above head height so that the sector includes the zone of the room occupied by people in the room. The second reference plane "SRP" is a plane perpendicular to the sheet in FIG. 1 that includes the lamp axis. The SRP essentially corresponds to the wall of a room; the light of the present invention is designed as a "wall" version that conforms to UL® standards. The third reference plane ("TRP") is a plane perpendicular to the lamp and, therefore, perpendicular to both the FRP and the SRP, at the axial centerline of the lamp.

The reflector 24 has a first reflective surface 241 that is positioned in a first quadrant defined by the FRP and the TRP and is on the same side of the SRP as the sector. The surface 241 is configured and oriented to reflect light from the lamp into the sector predominantly in a range of angles of from about 10 degrees to about 40 degrees with respect to FRP. A second reflective surface 242 is located in a second quadrant defined by the FRP the TRP that is diagonally opposite from the quadrant in which the first reflective surface 241 is located and is also on the same side of the SRP as the sector. Stating it differently, both the first and second reflective surfaces 241 and 242 are located in front of the SRP. The second reflective surface 242 is configured and oriented to reflect light from the lamp into the sector predominantly in a range of angles of from about 10 degrees to about 40 degrees with respect to the first reference plane. The first and second reflective surfaces together enhance the light output in a direction away from the wall on which the light is mounted and somewhat downwardly so that the light from the lamp is highly visible at large distances. The first and second reflective surfaces 241 and 242 are planar and, in order to reflect the light from the lamp in the desired directions and given the fact that the surface 241 is above the lamp while the surface 242 is below the lamp, are oriented obliquely to all three reference planes at different angles with respect to each of the reference planes so as to reflect light from the lamp into substantially the same 10 degree to 40 degree region of the sector. Locating the first and second reflective surfaces in diagonally opposite quadrants leaves openings in the remaining two quadrants through which the light can pass generally parallel to the axis of the lamp, thereby enabling the reflector wings of the above-mentioned Jongewaard application to be provided.

In particular, the reflector has a third reflective surface 243 that is positioned in the first quadrant on the opposite side of the SRP from the sector and a fourth reflective surface 244 that is positioned in the second quadrant, also on the opposite side of the SRP from the sector. Thus, the surfaces 241 and 243 are in the same quadrant, and the surfaces 242 and 244 are in the same quadrant, the latter quadrant being diagonally opposite from the quadrant of the surfaces 241 and 243. The surfaces 243 and 244 are located behind the SRP, i.e., behind the lamp. The third and fourth reflective surfaces face generally toward each other and are configured and oriented to receive light from the lamp and reflect it opposite directions along paths generally parallel to the lamp axis and on opposite sides of the first reference plane so that each one of the third and fourth reflective surfaces directs reflected light predominantly past the other of the third and fourth first and second reflective surfaces. The third and fourth surfaces are identical and located symmetrically with respect to the center of the lamp and are doubly concavely curved such that they reflect light within predetermined angles with respect to the lamp axis in planes parallel to the FRP and within predetermined angles with respect to the lamp axis in planes parallel to the SRP. The surfaces 243 and 244 enhance the intensity as the light as viewed from locations close to the wall and to one side or the other of the location of the lamp. Reference may be made to the above-mentioned Jongewaard application for a further description of the concepts of the third and fourth reflective surfaces 243 and 244 of the reflector 24. In the embodiment, the surfaces 243 and 244 are nearly perpendicular to the SRP, inasmuch as the axis of the lamp is closer to them with respect to the SRP than in the embodiment of the Jongewaard application.

Figure 3:
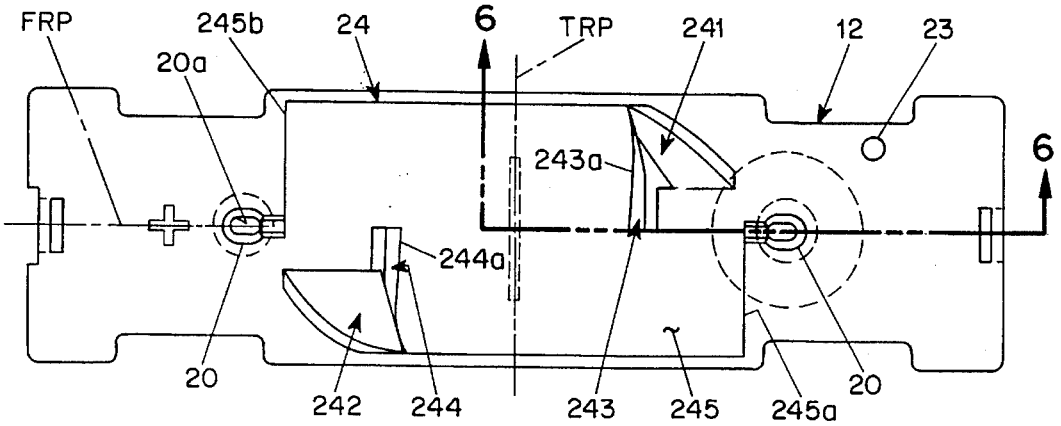
FIG. 3 is a front elevational view of the reflector.
Figure 4:
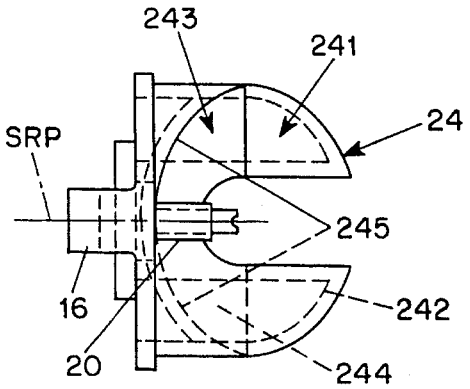
FIG. 4 is an end elevational view of the left end of the reflector.
Figure 5:
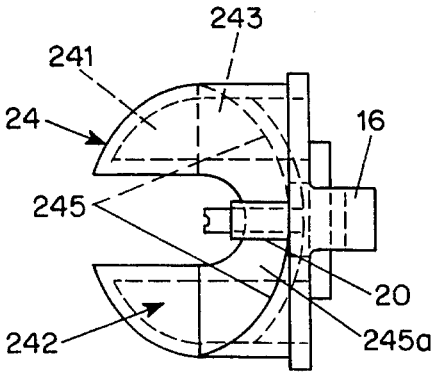
FIG. 5 is an end elevational view of the right end of the reflector.

A fifth reflective surface 245 is located on the opposite side of the SRP from the sector, i.e., behind the lamp 10, and is configured and oriented to reflect light from the lamp in divergent directions generally radially with respect to the lamp axis in the direction of the sector with respect to the SRP. The fifth reflective surface 255 is a segment of a cylindrical reflective surface, such as a parabolic surface, that is concave with respect to the axis of the lamp and has its axis coincident with the axis of the lamp. The surface 245 intersects the respective surfaces 243 and 244 at lines **243*a* and 244*a* (FIG. 3) and ends at end walls 245*a* and 245*b* that lie perpendicularly to the plane of the base of the support 12. The end portions of the surface 245 adjacent the walls 245*a* and 245*b*** are located laterally beyond the ends of the lamp, with respect to the TRP and reflect light at low angles, thus enhancing the amount of light directed laterally with respect to the TRP.

Figure 8:
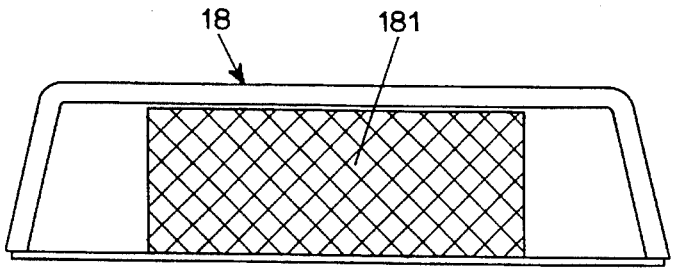
FIGS. 8, 9 and 10 are bottom cross-sectional, end cross-sectional and rear elevational views, respectively, of the lens of the embodiment.
Figure 9:
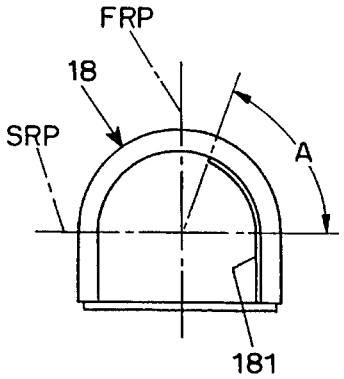
Figure 10:
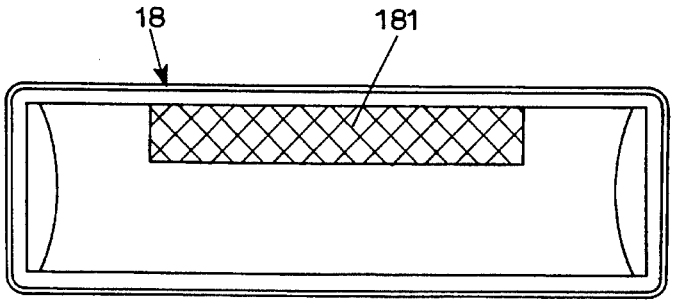

The lens 18 (FIGS. 8 to 10) has a reflective surface 181 that is located on the same side of the second reference plane as the sector and on the opposite side of the first reference plane from the sector and that is configured and oriented to reflect light from the lamp into the sector predominantly in a range of angles of from about 70 degrees to about 90 degrees with respect to the first reference plane. The portion of the reflective surface 181 of the lens 18 includes part of the flat upper wall and a segment of a cylindrical reflective surface that is concave with respect to the axis of the lamp and has its axis substantially parallel to the axis of the lamp. The portion in question covers an arc A of approximately 70 degrees beginning at the SRP and ending 20 degrees short of the FRP. The remaining part of the reflective surface 181 indicated by the hatching provides for reflecting all light directed vertically upward. In this regard, all of the surfaces of the support 12 facing away from the wall have a reflective coating in order to direct all light from the lamp away from the wall. The reflective surface 181 of the lens 18 is substantially coextensive with the lamp in the axial direction. If desired, instead of having a reflective coating on the lens, a separate member having a reflective surface may be attached to the inside of the lens. For example, it may be advantageous to have a reflective surface having a shape different from that of the lens.

We claim:

1. A strobe warning light adapted to project light predominantly into a sector defined by mutually perpendicular first and second reference planes intersecting at a line L, comprising an elongated strobe lamp having a longitudinal axis, a lamp support supporting the lamp with its axis coincident with the line L and centered on a third reference plane that is perpendicular to the first and second reference planes, and a reflector on the support that includes a first reflective surface that is positioned exclusively in a first quadrant defined by the first and third reference planes and is exclusively on the same side of the second reference plane as the sector and that is configured and oriented to reflect light from the lamp into the sector predominantly in a range of angles of from about 10 degrees to about 40 degrees with respect to the first reference plane, at least a portion of said first reflective surface being at a height greater than the top of the lamp, with respect to the second reference plane, at least some light reflected by the first reflective surface being emitted from the strobe warning light through a second quadrant, said second quadrant being on the same sector as the first quadrant and defined by the first and third reference planes.

2. A strobe warning light according to claim 1 wherein the reflector includes a second reflective surface that is positioned exclusively in a third quadrant defined by the first and third reference planes diagonally opposite from the first quadrant in which the first reflective surface is located and is exclusively on the same side of the second reference plane as the sector and that is configured and oriented to reflect light from the lamp into the sector predominantly in a range of angles of from about 10 degrees to about 40 degrees with respect to the first reference plane, at least a portion of said second reflective surface being at a height greater than the top of the lamp, with respect to the second reference plane, at least some of the light reflected by the second reflective surface being emitted from the strobe warning light through a fourth quadrant defined by the first and third reference planes diagonally opposite from the second quadrant.

3. A strobe warning light according to claim 2 wherein the first and second reflective surfaces are planar.

4. A strobe warning light according to claim 3 wherein the first and second reflective surfaces are oriented obliquely to all three reference planes at different angles with respect to each of the reference planes so as to reflect generally equal amounts of light from the lamp into substantially the same region of the sector.

5. A strobe warning light according to claim 2 wherein the reflector further includes a third reflective surface that is positioned substantially exclusively in the first quadrant on the opposite side of the second reference plane from the sector and a fourth reflective surface positioned substantially exclusively in the third quadrant on the opposite side of the second reference plane from the sector, the third and fourth reflective surfaces facing generally toward each other and being configured and oriented to receive light from the lamp and reflect it in opposite directions along paths generally parallel to the longitudinal axis and on opposite sides of the first reference plane so that each one of the third and fourth reflective surfaces directs reflected light predominantly past the other of the third and fourth reflective surfaces.

6. A strobe warning light according to claim 5 wherein the third and fourth reflective surfaces are substantially identical and are located substantially symmetrically with respect to the center of the lamp.

7. A strobe warning light according to claim 5 wherein the third and fourth reflective surfaces are doubly concavely curved such that they reflect light within predetermined angles with respect to the longitudinal axis.

8. A strobe warning light according to claim 5 wherein the reflector further includes a fifth reflective surface that is located substantially exclusively on the opposite side of the second reference plane from the sector and is configured and oriented to reflect light from the lamp in divergent directions generally radially with respect to the longitudinal axis in the direction of the sector with respect to the second reference plane.

9. A strobe warning light according to claim 8 wherein the fifth reflective surface is a segment of a cylindrical surface that is concave with respect to the axis of the lamp and has its axis substantially parallel to the longitudinal axis of the lamp.

10. A strobe warning light according to claim 9 wherein the fifth reflective surface is parabolic.

11. A strobe warning light according to claim 10 wherein the third and fourth reflective surfaces adjoin the fifth reflective surface.

12. A strobe warning light according to claim 11 wherein portions of the fifth reflective surface opposite from the junctures of the fifth reflective surface with the third and fourth reflective surfaces extend beyond the extremeties of the lamp so as to reflect light generally laterally with respect to the third reference plane.

13. A strobe warning light according to claim 2 and further comprising a transparent lens attached to the lamp support and covering the lamp and the reflector and a reflective surface associated with the lens that is located substantially exclusively on the same side of the second reference plane as the sector and on the opposite side of the first reference plane from the sector and that is configured and oriented to reflect light from the lamp into the sector predominantly in a range of angles of from about 70 degrees to about 90 degrees with respect to the first reference plane.

14. A strobe warning light according to claim 13 wherein the reflective surface associated with the lens is a segment of a cylindrical surface that is concave with respect to the axis of the lamp and has its axis substantially parallel to the axis of the lamp.

15. A strobe warning light according to claim 13 wherein the reflective surface associated with the lens is substantially coextensive with the lamp in the axial direction.

16. A strobe warning light according to claim 15 wherein the reflective surface associated with the lens is a coating on the inside surface of the lens.

* * * * *